US006835124B2

(12) United States Patent
Stephan

(10) Patent No.: US 6,835,124 B2
(45) Date of Patent: Dec. 28, 2004

(54) ADJUSTABLE SANDING BLOCK

(76) Inventor: Gerard Stephan, 162 Miller Place Rd., Miller Place, NY (US) 11764

( * ) Notice: Subject to any disclaimer, the term of this patent is extended or adjusted under 35 U.S.C. 154(b) by 93 days.

(21) Appl. No.: 10/354,597

(22) Filed: Jan. 30, 2003

(65) Prior Publication Data

US 2004/0152405 A1 Aug. 5, 2004

(51) Int. Cl.[7] ..... B24B 21/00; B24B 23/00

(52) U.S. Cl. ..... 451/313; 451/355; 451/495; 451/513; 451/523

(58) Field of Search ..... 451/296, 311, 451/313, 344, 355, 490, 495, 504, 512, 513, 523, 524

(56) References Cited

U.S. PATENT DOCUMENTS

| | | | | | |
|---|---|---|---|---|---|
| 2,414,036 | A | | 1/1947 | Gerhan | 51/185 |
| 2,457,466 | A | * | 12/1948 | Hanna | 451/519 |
| 2,761,257 | A | | 9/1956 | Mendelsohn | 51/186 |
| 3,063,208 | A | * | 11/1962 | Bell et al. | 451/504 |
| 3,429,077 | A | | 2/1969 | Grover | 51/148 |
| 3,601,933 | A | * | 8/1971 | Bowen | 451/504 |
| 3,975,868 | A | | 8/1976 | Botimer | 51/358 |
| 4,525,959 | A | | 7/1985 | Ziebarth et al. | 51/391 |
| 4,813,189 | A | * | 3/1989 | Bolduc | 451/513 |
| 5,383,308 | A | * | 1/1995 | Beloff et al. | 451/519 |
| 5,387,251 | A | | 2/1995 | Rouse | 451/513 |
| 5,720,654 | A | * | 2/1998 | Mac Donald | 451/523 |
| 6,213,857 | B1 | | 4/2001 | Duquette | 451/513 |

* cited by examiner

*Primary Examiner*—Timothy V. Eley
(74) *Attorney, Agent, or Firm*—Alfred M. Walker

(57) ABSTRACT

A sanding block holds a continuous loop sanding belt tightly thereon. The block includes a hollow block body including a spring clamp having top and bottom racks of serrated indented teeth, which extend longitudinally therein, forming the top and bottom gear racks. Each of these gear racks engages reciprocal top and bottom gear racks with serrated indented teeth extending longitudinally along top and bottom forked members the spring clamp. The spring clamp is positioned within the hollow block body so that the continuous loop sanding belt can be tightly fit over the hollow block body.

11 Claims, 3 Drawing Sheets

ADJUSTABLE SANDING BLOCK

FIELD OF THE INVENTION

The present invention relates to construction sanding blocks.

BACKGROUND OF THE INVENTION

When using a sanding block, a flat piece of sandpaper is bent around the edges of a sanding block body. This results in waste of the sandpaper at the bent edges. In addition, after the surface is worn out, the sandpaper piece must be taken off the block and readjusted, but only, if there are any fresh portions available and if the flat piece of sandpaper still has adequate edges to be bent over the sanding block.

In contrast, when a mechanical sanding belt machine is used, a continuous loop sanding belt is applied over the sanding roller. However, this requires expensive sanding roller machines, which are not suitable for small detailed use by hand.

Among related patents for hand held sanding blocks include U.S. Pat. No. 3,414,036 of Gerhan and U.S. Pat. No. 5,387,251 of Rouse, which both show gear racks with teeth to tighten or loosen a sanding block.

U.S. Pat. No. 3,429,077 of Grover also uses teeth to tighten a hinged sanding belt block.

However, in Gerhan '036, the sanding block includes two solid members, which must have teeth permanently attached therein or attached by a knob insertable within a hole in the body of the block. The length of the sanding block of Gerhan '036 is adjusted by moving the two solid block bodies either away or toward each other. That requires disassembling and attaching the blocks to each other each time the length of the sanding block must be changed.

Moreover, both Rouse '251 and Grover '077 require a single pivotable hinged pin to be readjusted to different teeth of a gear rack. However, the pivoting pins in Rouse '251 and Grover '077 are more precariously held in place, and might cause injury to the user's hand by suddenly slipping out of place.

Other patents which do not use gear racks for adjusting the length of a hand held sanding block include U.S. Pat. No. 2,761,257 of Mendelsohn, for a sanding belt block that uses springs, U.S. Pat. No. 6,213,857 of Duquette that uses an expanding wedge to tighten a sanding belt about the sanding block, U.S. Pat. No. 6,196,909 of Cadrobbi that moves a tension adjuster laterally to adjust the tension of the continuous sanding belt block, U.S. Pat. No. 3,975,868 of Botimer that holds sandpaper sheets with tucked-in edges and U.S. Pat. No. 4,525,959 of Ziebarth, that uses a wedge to tighten or loosen a sanding block tool.

OBJECTS OF THE INVENTION

Therefore there is a necessity to provide an adjustable sanding block which can hold a continuous loop sanding belt in place for convenient manual sanding of a surface, while maximizing the useful life of the sanding surface of the sanding belt.

It is also an object of the present invention to provide a reliable, accessible and easily insertable adjustment member which is inserted into a hollow body accommodating an endless sandpaper belt thereon, wherein the adjustment member adjusts the length of the sanding block.

Other objects which become apparent from the following description of the present invention.

SUMMARY OF THE INVENTION

In keeping with these objects and others, which may become apparent, the present invention includes a sanding block for holding a continuous loop sanding belt tightly thereon.

For the purposes of definition of the orientation of the sanding block, the "top" and "bottom" of the sanding block is shown as providing access to the interior of the sanding block, and the front, rear and opposite sides of the sanding block are shown surrounding by an endless sanding belt. In such an orientation, the vertically extending sides of the sanding block can be used to sanding vertical surfaces, such as sheetrock walls.

However, also for the purpose of definition, it is noted that the sanding block can be rotated ninety degrees about its horizontal axis, so that the endless sanding belt is now facing up and down, for use in sanding horizontal surfaces, such as sheetrock ceilings or wooden floors.

It includes a hollow block body having a rack of serrated indented teeth extending longitudinally therein to form respective top and bottom gear racks.

The hollow block body is an open enclosure, which is open at an end thereof. The hollow block body preferably is rectangular with flat side walls. The spring clamp is inserted into the hollow block body through the open end for adjusting a length of the sanding block. The endless belt of sandpaper surrounds the hollow block.

Each of the gear racks engages reciprocal serrated indented teeth extending longitudinally along top and bottom forked members of a locking member, such as, for example, a spring clamp. The spring clamp member is insertable within the hollow block body and it extends a first predetermined length of the hollow block body to a longer length, so that the continuous loop sanding belt can be tightly fit over the hollow block body, as extended in length by a portion of the spring clamp extending from the hollow block body.

The teeth are provided along the inside of the top and bottom walls adjacent sides of each extended slot of the hollow block body. The teeth are adapted to engage the teeth on the top and bottom walls located on the extended arms of the spring clamp, so that the spring clamp, when inserted into the hollow block body, is held in place by the engagement of the teeth on the top and bottom walls of the hollow block body and the extended arms of the spring clamp;

Preferably, an optional button is provided on each of the distal ends of the extended arms of the spring clamp, and is accessible through the slots, allowing the extended arms to be pressed toward each other, to disengage the teeth, to allow the position of the spring clamp to be adjusted within the hollow block body.

The locking means is accessed through walls not covered by the endless belt, to allow tensing of the endless belt for sanding, and for release of tension, to allow the endless belt to be adjusted on the hollow block body, to provide a new sanding surface or replacement of the endless sanding belt.

Preferably, the spring clamp is a U-shaped member with outwardly extending arms, whose distal ends are biased away from each other, and a back edge joining proximal ends of the arms. The back edge of the U-shaped spring clamp extends out one end of the hollow block body, to contact the endless belt, for tensing or releasing tension on the endless belt.

These outwardly extending arms are toothed and these teeth engage the respective teeth of the interior of the hollow block body, to hold the adjusting spring clamp in place.

The hollow block body of the adjustable sanding block has openings for access to the toothed arms of the spring clamp, to allow adjustment of the position of the spring clamp or other adjusting means within the hollow block body. For example, the access opening may be extended slots in opposite walls of the hollow block body which are not covered by the endless belt.

The endless belt of sandpaper surrounds the hollow block body, and the endless belt extends along the side walls and ends of the hollow block body, wherein the back of the spring clamp is adjustable, to tense the endless belt for use in sanding. The spring clamp is retracted to allow the position of the endless belt on the hollow block body, to allow the endless belt to be changed and replaced.

When in use, the continuous loop sanding belt is taut, and provides a coarse or fine sanding surface over the hollow block body.

DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE PREFERRED EMBODIMENTS

Figure 1:
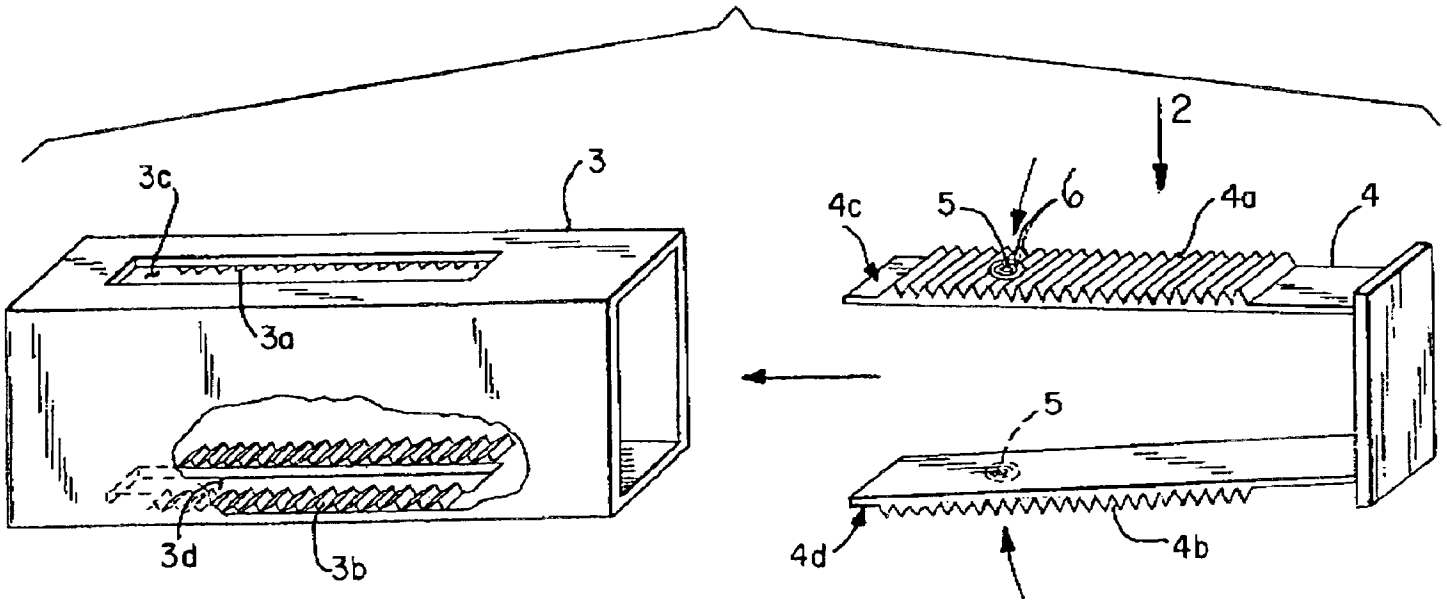
FIG. 1 is an exploded side perspective view of the adjustable sanding block of the present invention, wherein the arrows show the insertion direction of the spring clamp into the hollow block body and the bending direction of the spring clamp, prior to insertion.
Figure 2:
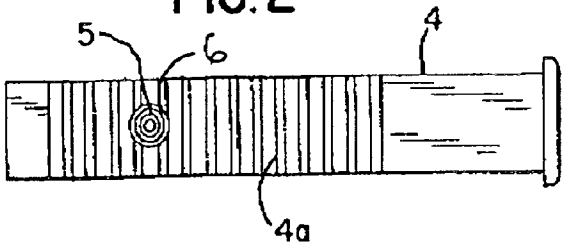
FIG. 2 is a top plan view of the spring clamp portion thereof.
Figure 3:
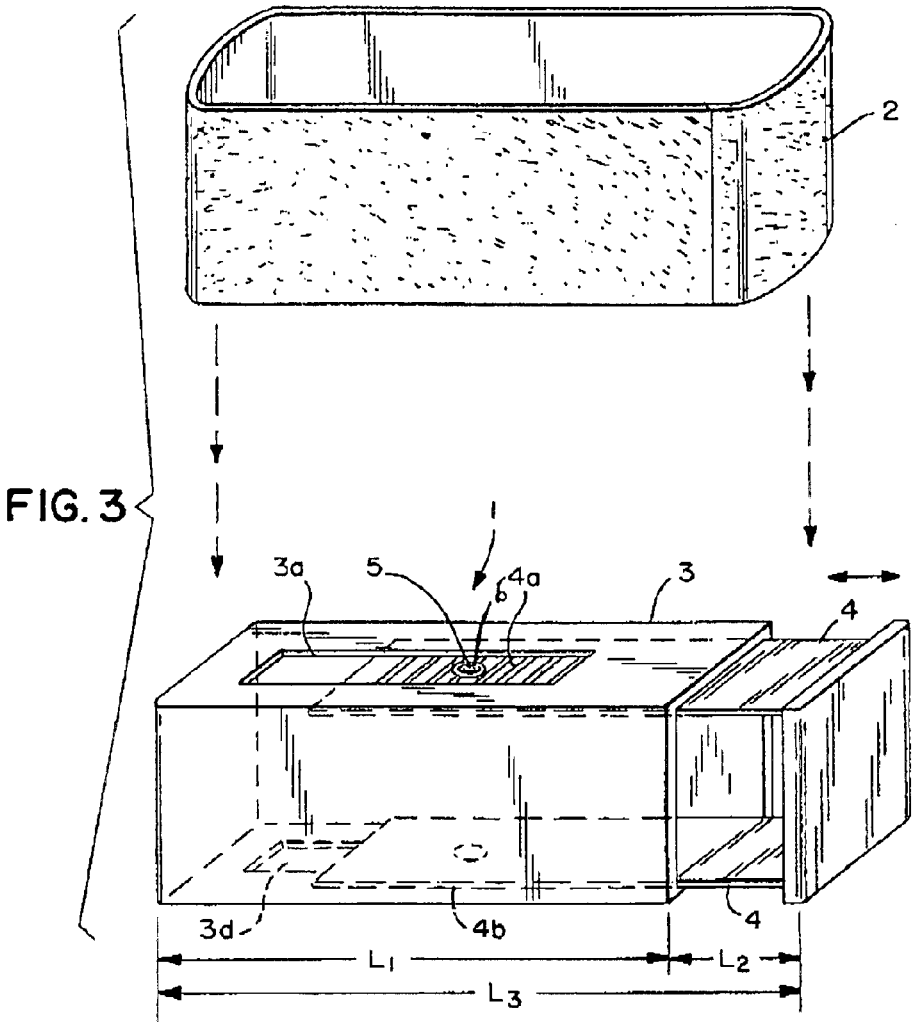
FIG. 3 is an exploded perspective view, in partial cutaway, showing insertion of the continuous loop sanding block over the hollow block body, after the spring clamp has been moved partially out of the hollow block body to a combined length to hold the continuous loop sanding belt taut thereon.
Figure 4:
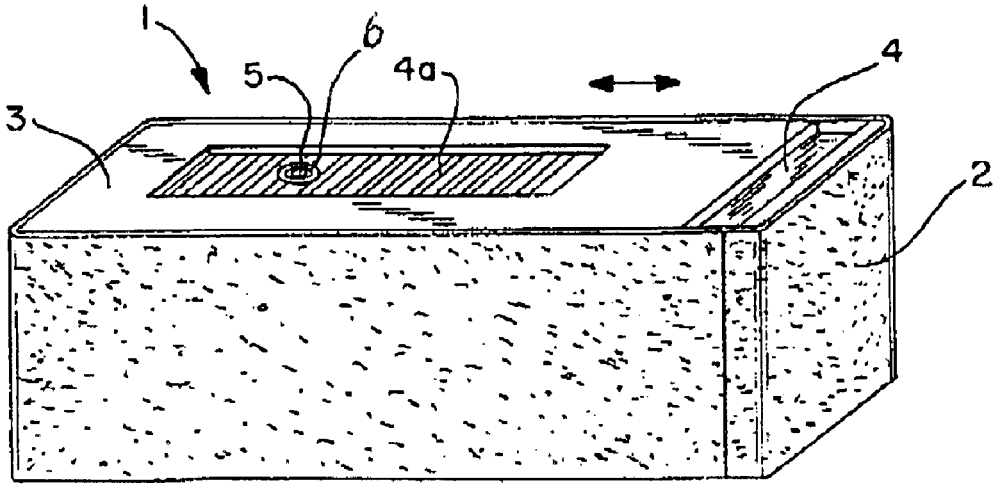
FIG. 4 is a side perspective view showing the continuous loop sanding belt in place over the extended length of the hollow block body and exterior extending portion of the spring clamp; and, FIG. 5 is a perspective view of an alternate embodiment with a hollow block body having rounded edges.

The present invention has broad applications to many technical fields for a variety of articles. For illustrative purposes only, a preferred mode for carrying out the invention is described herein.

The present invention includes a sanding block 1 for holding a continuous loop sanding belt 2 tightly thereon. It includes a hollow block body 3 having a spring clamp 4 with top and bottom racks 4*a*, 4*b* of serrated indented teeth extending longitudinally therein to form respective top and bottom gear racks 4*a*, 4*b*. Each of the gear racks 4*a*,4*b* of spring clamp 4 engages reciprocal top and bottom interior gear racks 3*a*, 3*b* of hollow block body 3. Interior gear racks 3*a*, 3*b* have respective sets of serrated indented teeth extending longitudinally along top and bottom interior walls of hollow block body 3. Respective teeth of these gear racks 3*a*, 3*b* engage respective teeth of the gear racks 4*a*, 4*b* of the spring clamp 4.

The spring clamp 4 is insertable within an end hole of the hollow block body 3. Spring clamp 4 extends a first predetermined length $L_1$ by a second added length $L_2$, of the hollow block body 3, to a longer total length $L_3$, so that the continuous loop sanding belt 2 can be tightly fit over the hollow block body 3, as extended in length by the added length $L_2$ of the portion of the spring clamp 4 extending outward from the hollow block body 3.

The meshing of teeth 3*a* with teeth 4*a* and teeth 3*b* with teeth 4*b* locks the spring clamp into the desired position of use with sanding belt 2.

When in use, the continuous loop sanding belt 2 is taut, and provides a coarse or fine sanding surface over the outside of the hollow block body 3.

Holding tabs 5 and recess dimples 6 enable the user to depress spring clamp 4 in and out of position. To reach holding tabs 5, hollow block body 3 has top and bottom holes 3*c* and 3*d* to reach in and manually engage tabs 5 upon forked members 4*c* and 4*d* of spring clamp 4.

To use the adjustable length sanding block, the user rotates the combined sanding belt 2 and hollow body block 3 ninety degrees about its horizontal axis, so that the sanding belt 2 is then facing downward toward the surface to be sanded.

Figure 5:
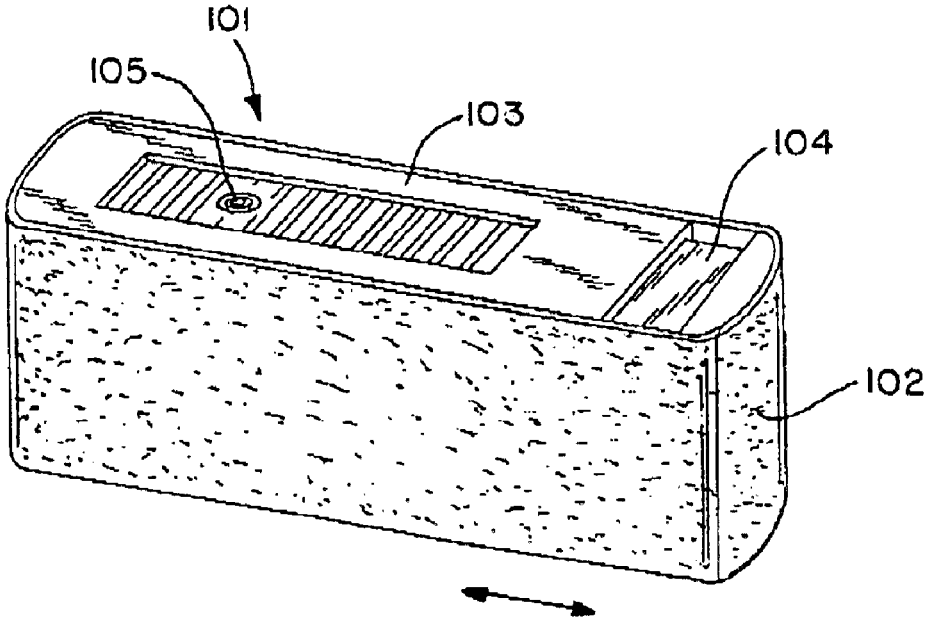

In the alternative view of FIG. 5, an alternate embodiment for an adjustable sanding block 1 includes hollow block body 103, having rounded edges, and spring clamp 104 with tabs 105, for holding sanding belt 102. Hollow body block 103 can optionally have rounded edges, as shown in FIG. 5, to more easily hold the sanding belt 2 in place.

A benefit of the present invention is that a user can, after using the continuous loop sanding belt 2 is in a first position for an extended period of time with worn-out surface portions, loosen the sanding belt 2 and reposition it upon the hollow block body 3 with a fresh sanding surface at the intended sanding point of contact. Therefore a user can extend the life of the continuous loop sanding belt 2.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention.

I claim:

1. An adjustable sanding block comprising:

a hollow block member having flat side walls forming an enclosure open at an end;

a U-shaped member having a pair of arms, said U-shaped member insertable into said block member through said open end for adjusting a length of said block member;

a plurality of teeth in said block member engageable with a corresponding plurality of teeth on said U-shaped member for locking said U-shaped member in place within said hollow block member;

an endless sanding belt of sandpaper surrounding said hollow block member; and said locking U-shaped member being accessed through at least one slot in said hollow block member not covered by said endless sanding belt, to allow tensing of said belt for sanding and release of tension, to allow said endless sanding belt to be adjusted in said hollow block member, to provide a new sanding surface or replacement of said endless sanding belt.

2. The adjustable sanding block of claim 1 in which said arms of said U-shaped member each has distal ends which are biased away from each other when said U-shaped member is insertable into said hollow block member, said U-shaped member having a back joining proximal ends of said arms, said back extending out one end of said block member for contacting said endless sanding belt for tensing or releasing tension on said endless sanding belt.

3. The adjustable sanding block of claim 2 in which said teeth are located in respective opposite interior walls of said hollow block member, said teeth engaging said corresponding teeth on said arms of said U-shaped member for holding said U-shaped member in place.

4. The adjustable sanding block of claim 3 in which said hollow block member has openings for access to the toothed arms of said adjusting means to allow adjustment of the position of said U-shape member within said hollow block member.

5. The adjustable sanding block as in claim 1 further comprising at least one user-operable button tab located on an outer portion of said U-shaped member.

6. The adjustable sanding block as in claim 5 wherein said at least one botton tab is dimpled.

7. An adjustable sanding block comprising:

a block member having a pair of side walls parallel to each other and a pair of top and bottom walls perpendicular to said side walls forming an enclosure open at first and second ends;

an extended slot in each of said top and bottom walls;

a U-shaped spring clamp having a back and a pair of extended arms adapted to slide into said block member through said first end, said arms being spring members biased to spread outwardly from each other do that said spring members must be pressed toward each other so that said into said block member;

teeth along the inside of said top and bottom walls adjacent sides of each extended slot;

teeth adapted to engage the teeth on said top and bottom walls located on said extended arms of sake spring clamp so that said spring clamp when inserted into said block member is held in place by the engagement of the teeth on said top and bottom walls and said extended arms of said spring clamp;

a user-operable button tab on each of distal ends of said extended arms accessible through said slots allowing said extended arms to be pressed toward each other to disengage the teeth to allow the position of said spring clamp to be adjusted within said block member; and an endless belt of sandpaper surrounding said block member, said belt extending along the side walls and ends of said block member, the back of said spring member being adjustable to tense said belt for use in sanding and retracted to allow the position of said belt on said block member to be changed to provide a new sanding surface on said belt of sandpaper or to replace said endless belt.

8. The adjustable sanding block as in claim 7 wherein said at least one button tab is dimpled.

9. An adjustable sanding block comprising:

a continuous loop sanding belt engaging around a hollow block body;

said hollow block body having at least one side access hole for accessing a removable spring clamp therein, said spring clamp having a pair of outwardly extending forked members extending from a common edge;

said hollow block body further having respective top and bottom interior gear racks of serrated indented teeth, said gear racks extending longitudinally within said hollow block body, each of said gear racks engaging corresponding reciprocal top and bottom exterior gear racks respectively of said forked members of said spring clamp, each of said gear racks of said spring clamp having serrated indented teeth extending longitudinally along respective upper and lower members of said spring clamp, said spring clamp being positioned within said hollow block body for adjusting tension against front and rear edges of said continuous loop sanding belt being held tightly over said hollow block body.

10. The adjustable sanding block as in claim 9 further comprising at least one user-operable button tab located on an outer portion of said spring clamp.

11. The adjustable sanding block as in claim 10 wherein said at least one button tab is dimpled.

* * * * *